United States Patent [19]

Harrington et al.

[11] Patent Number: 4,534,252

[45] Date of Patent: Aug. 13, 1985

[54] LEDGER FOR CUT-OFF DEVICES IN CIGARETTE MACHINES

[75] Inventors: Timothy C. Harrington, Aylesbury; John K. Horsley, High Wycombe, both of England

[73] Assignee: Molins PLC, London, England

[21] Appl. No.: 439,610

[22] Filed: Nov. 5, 1982

[30] Foreign Application Priority Data

Nov. 5, 1981 [GB] United Kingdom ..... 8133404

[51] Int. Cl.[3] ..... B26D 1/56

[52] U.S. Cl. ..... 83/310; 83/311; 83/327; 83/926 C; 74/27; 74/52

[58] Field of Search ..... 83/310, 37, 926 C, 318-320, 83/329-330, 331, 327, 328; 74/27, 52, 98; 131/65

[56] References Cited

U.S. PATENT DOCUMENTS

| | | | |
|---|---|---|---|
| 1,797,786 | 3/1931 | Nicholson | 74/52 |
| 2,524,734 | 10/1950 | Pfau | 74/52 |
| 2,775,128 | 12/1956 | Young | 74/52 |
| 3,221,419 | 12/1965 | Cohen | 74/52 |
| 3,915,041 | 10/1975 | Trofimov et al. | 83/320 |
| 3,995,519 | 12/1976 | Labbe et al. | 83/310 |
| 4,444,210 | 4/1984 | Schumacher | 131/65 |

*Primary Examiner*—James M. Meister
*Assistant Examiner*—John L. Knoble
*Attorney, Agent, or Firm*—Antonelli, Terry & Wands

[57] ABSTRACT

A ledger mechanism for a rod cutting apparatus comprises a ledger; a coupling rod on which the ledger is fixedly mounted; and a pair of spaced gear arrangements each having a gear ratio of 2:1 to generate a pair of points, one point on each gear arrangement, which reciprocate in synchronism along straight parallel paths, wherein the coupling rod is pivotally coupled at one end to one of said pair of points on one gear arrangement, and at its opposite end to the other of said pair of points on the other gear arrangement so that the ledger reciprocates linearly.

7 Claims, 3 Drawing Figures

LEDGER FOR CUT-OFF DEVICES IN CIGARETTE MACHINES

The present invention relates particularly to ledger mechanisms for cut-off devices in cigarette machines and similar machines of the cigarette industry. Therefore the invention will be described in relation to cigarette or filter making machines. However it is applicable to any machine wherein a rod-like article is to be cut while moving and while being supported by a ledger which moves with the article during the cutting operation and then returns to a starting position after each cut.

According to the present invention there is provided a ledger mechanism for cut-off devices in cigarette machines comprising: a ledger; a coupling rod on which the ledger is fixedly mounted; and a pair of spaced gear arrangements each having a gear ratio of 2:1 to generate a pair of points, one point on each gear arrangement, which reciprocate in synchronism along straight parallel paths, wherein the coupling rod is pivotally coupled at one end to one of said pair of points on one gear arrangement, and at its opposite end to the other of said pair of points on the other gear arrangement so that the ledger reciprocates linearly.

According to a first embodiment of the invention each gear arrangement comprises a planetary gear with n external teeth meshing with a fixed gear having 2n internal teeth. The planetary gear orbits around the axis of the fixed gear and has a corresponding end of the coupling rod pivotally attached to a point on its pitch circle. Herein 'n' is an integral number.

According to a second embodiment of the invention, the gear arrangements each comprise a planetary gear with n external teeth and a fixed gear with 2n external teeth. The planetary gear orbits around the axis of the fixed gear but is spaced from the fixed gear by an idler gear which couples the two other gears. The coupling rod supporting the ledger is pivoted to a crank, fixed to the planetary gear. The effective length of the crank is equal to the distance between the axes of the fixed and planetary gears.

According to a third aspect of the present invention, the gear arrangements each comprise a planetary gear which orbits around the axis of a fixed gear and overlaps the fixed gear. A compound idler gear couples the other two gears and comprises a first gear meshing with the fixed gear and a coaxial second gear meshing with the planetary gear. The coupling rod is pivotally connected to the planetary gear at a radius equal to the distance between the axes of rotation of the fixed and planetary gears.

It is an advantage of this invention that the rotary motion of the various parts of the gear mechanisms allows substantial balancing to be achieved despite the fact that the ledger itself reciprocates.

For a better understanding of the present invention and to show how the same may be carried into effect, reference will now be made to the accompanying drawings in which.

In modern cigarette making machines such as the Molins Mk 8 or Mk 9 described for example in British Patent Specfication No. 929,338, cigarettes are made by forming a continuous moving rod which is then cut into individual cigarette lengths while the rod moves past a rotating knife; alternatively, double-length portions may be cut from the continuous rod. Each cut takes a finite time to complete and it is usual to use a knife mechanism whereby the portion of the knife engaging the rod moves with the rod while cutting it, so as to make a proper transverse cut without damaging the rod. The drawings illustrate a ledger for supporting the rod during each cutting operation.

Figure 1:
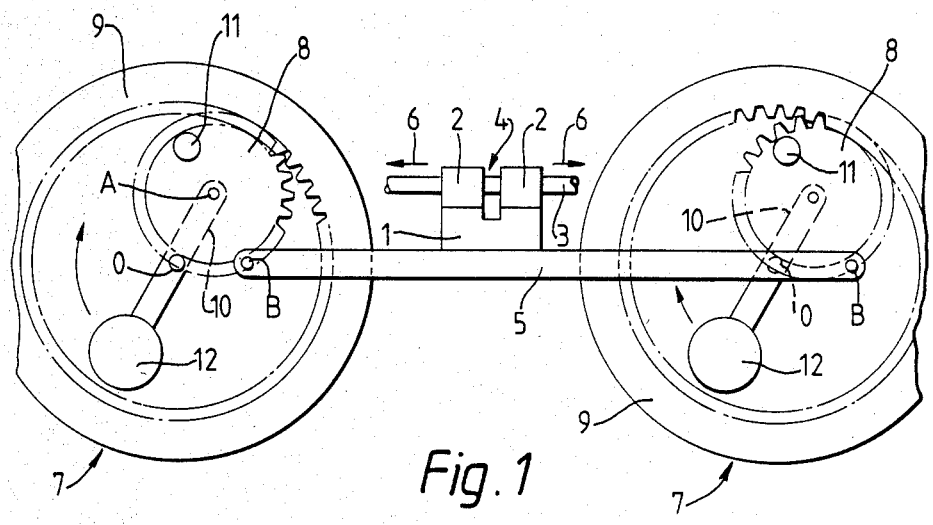
FIG. 1 is a schematic representation of one embodiment of a ledger mechanism according to the invention.

FIG. 1 shows a ledger block 1 which comprises two spaced ledger tubes 2 through which a continuous moving cigarette rod 3 passes. The space 4 between the ledger tubes 2 is for a rotating knife (not shown) to pass through. Such a knife rotates in a plane generally perpendicular to the plane of the paper in FIG. 1.

The ledger block 1 is mounted on a coupling rod 5 which is caused to reciprocate in a horizontal plane, as indicated by arrows 6, by gear arrangements 7 at opposite ends of the coupling rod 5. Each of these gear arrangements 7 comprise a planetary gear 8, with n external teeth and a pitch circle diameter d, which meshes with fixed gear 9 with 2n internal teeth and a pitch circle diameter 2d, i.e. twice that of the planetary gear. The coupling rod 5 is pivoted at its ends to points B on the pitch circles of respective planetary gears 8. The planetary gears 8 are each driven around centers O of their associated fixed gears 9 by driving crank shafts 10.

Owing to the 1:2 ratio between the planetary gears 8 and the fixed gears 9, the planetary gears 8 will rotate exactly twice about their own centers A for each revolution they perform around the fixed gears 9. Thus any point on the pitch circle of planetary gear 8 will follow a straight line path through the center O of the associated fixed gear 9, i.e. will reciprocate linearly along a diameter of internal gear 9. The points B are chosen such that they reciprocate in a plane parallel to the cigarette rod axis, causing the coupling rod 5 and thus the ledger block 1 to do likewise.

The mass of the ledger block 1 and coupling rod 5 is balanced for rotation about the centers A by equal counter weights 11 fixed to the respective planetary gears 8. The masses of the planetary gears 8, the counter weights 11, the ledger block 1 and the coupling rod 5 are balanced for rotation about centers O by counter weights 12 fixed to the driving cranks 10. Having thus balanced the reciprocating masses, there will be no cyclical variation of the torgue required to drive the cranks 10.

The ledger tube velocity varies sinusoidally and is arranged to equal the cigarette rod velocity at mid-stroke. Therefore the driving cranks 10 are driven at machine speed, so that they make one revolution for each rod portion cut off the continuous rod 3.

The rod 3 travels a total distance of 2 multiplied by the radius of the fixed gear 9 during each cycle of the mechanism. Thus, for example, if each rod portion cut off has a length of 100 mm:

$$\text{Radius of fixed gear } 9 = 100/2 = 15.92 \text{ mm}$$

and radius of planetary gear $8 = 15.92 \times 0.5 = 7.96$ mm.

These are obviously tiny dimensions and would be rather impractical for a cigarette machine where cigarette lengths may need to be changed periodically, requiring changes in the dimensions of the gears.

Figure 2:
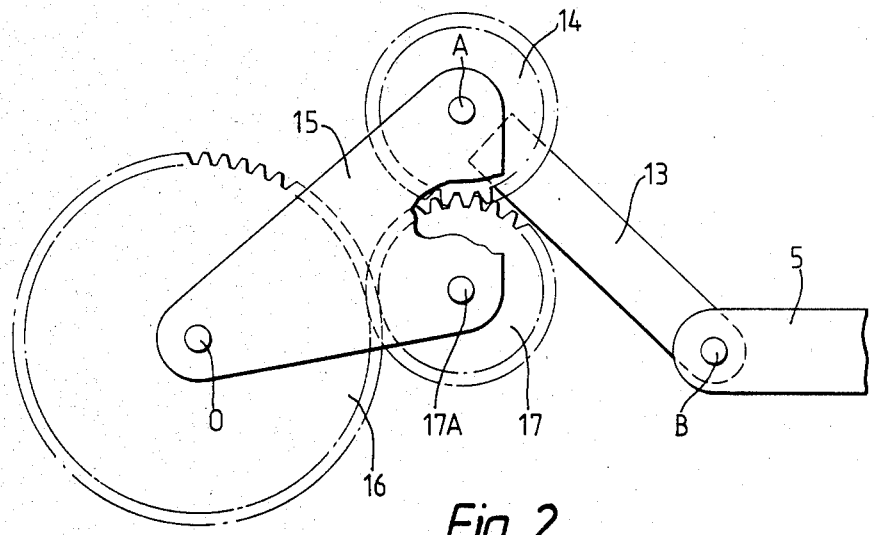
FIG. 2 shows a detail of a second embodiment of a ledger mechanism according to the invention.

FIG. 2 shows an alternative form for each gear arrangement 7. The coupling rod 5 is pivotally connected at B to one end of a crank 13. The opposite end of crank 13 is fixed to a planetary gear 14 with n external teeth. The centers A of gear 14 is driven by a crank 15 around the centers O of a fixed gear 16 which has 2n external teeth. A planetary idler gear 17 meshes with both gears 14 and 16, being rotatably mounted on the crank 15 at 17A. The cranks 13 and 15 are of equal length. It can be seen that point B and hence the coupling rod 5 will reciprocate along a straight line through the centers O of the fixed gear 16. Hence the ledger block 1 mounted on the coupling rod 5 will also reciprocate along a straight path.

The stroke of this mechanism can be altered in order to make different length cigarettes by changing for each gear arrangement the distance OA between the centers of the gears 16 and 14, and the length of crank 13, i.e. by changing by equal amounts the lengths of the two cranks 13 and 15. As noted above with reference to FIG. 1, the dimensions involved are of the order of a few millimeters and so the requisite accuracies would be extremely difficult to achieve.

Figure 3:
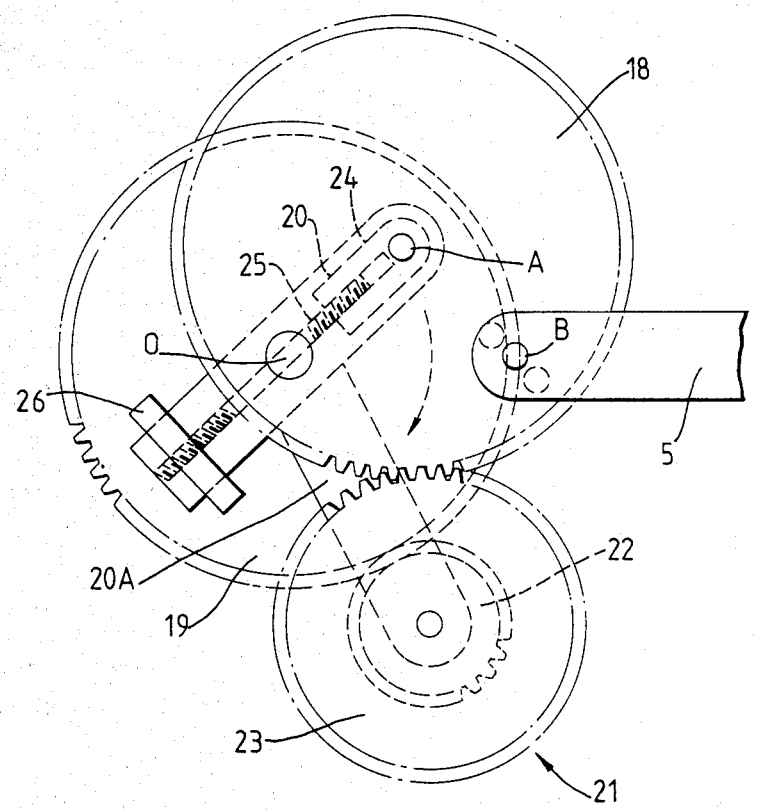
FIG. 3 illustrates a detail of a third embodiment of the invention.

FIG. 3 illustrates a form for the gear arrangement 7 of FIG. 1 which is more adaptable for length changes.

In this embodiment, an end of the coupling rod 5 is carried by a pivot B fixed to a planetary gear 18. Planetary gear 18 overlaps a fixed gear 19 and is orbitally driven around the axis thereof by a crank 20. The planetary gear 18 is rotatably mounted on the crank 20 by a spindle A, but is coupled to the fixed gear 19 by a planetary compound idler gear 21 mounted on an arm 20A carried by the crank 20. The distance OA is arranged to be equal to the distance AB, and the gears 18 and 19 both have equal numbers of external teeth. The planetary compound idler gear 21 comprises a first gear 22 with n teeth meshing with the teeth of the fixed gear 19, and a larger second gear 23 with 2n external teeth meshing with the teeth of the planetary gear 18.

Point B and hence the coupling rod 5 with the ledger block reciprocates along a straight line which passes through the axis O of the fixed gear 19.

The stroke of this mechanism can be adjusted for different cigarette lengths by altering the distances OA and AB, i.e. changing the gear overlap and the distance of the point B from the center A of the planetary gear 18; no gear changes are necessary. For this purpose, for example, the spindle A is carried by a block 24 which is movably mounted on the crank 20, being adjusted in position along the crank by rotation of a screw-threaded member 25. The member 25 also engages a balance weight 26; threads on the member 25 engaging respectively the block 24 and weight 26 are of opposite hand so that rotation of the screw moves the block and weight in opposite directions whereby balance is retained. Similar adjustment and balancing may be provided for the pivot B, however, in order to avoid complicating the drawing excessively, FIG. 3 shows with respect to the pivot B only two alternative positions of the pivot in ghost outline.

The diameters of gears 18 and 19 can be chosen to be any convenient value and in fact it is not essential that they have equal numbers of teeth: provided that the number of teeth on the compound idler gear 21 is chosen so that the overall gear ratio is 2:1. When the position of the spindle 4 is altered in the manner described above, it is necessary to adjust the position of the idler gear 21 to keep the idler in mesh with the gears 18 and 19. For example, the arm 20A may be angularly adjusted with respect to the crank 20 about the axis O.

In place of the gear arrangements it is possible, in principle, to use other forms of rotary mechanisms which produce a linear motion of one point on each mechanism to which the coupling rod can be pivoted. However, the gear arrangements described above represent the preferred way of carrying out this invention.

We claim:

1. A ledger mechanism for a rod cutting apparatus, comprising a ledger; a coupling rod on which the ledger is fixedly mounted; and a pair of spaced gear arrangements each having a gear ratio of 2:1 to generate a pair of points, one point on each gear arrangement, which reciprocate in sycnhronism along straight parallel paths, wherein the coupling rod is pivotally coupled at one end to one of said pair of points on one gear arrangement, and at its opposite end to the other of said pair of points on the other gear arrangement so that the ledger reciprocates linearly, each gear arrangement comprising a planetary gear which orbits around an axis of a fixed gear and meshes with said fixed gear through an idler gear, first adjustment means for adjusting a first distance between the axes of said fixed and planetary gears, and second adjustment means for adjusting a second distance between the axis of said planetary gear and said point on said gear arrangement.

2. A ledger mechanism according to claim 1, in which at least one of said adjustment means comprises movable means, support means on which said movable means is movably supported, and operating means for adjusting the position of said movable means along said support means.

3. A ledger mechanism according to claim 2, in which said support means is mounted so that it extends radially from and rotates about the axis of said fixed gear, and said operating means comprises a screw-threaded member.

4. A ledger mechanism according to claim 3, further comprising a balance weight movably carried on said support means, wherein threads on opposite ends of said screw-threaded member respectively engage said movable means and said balance weight, so that said movable means and said balance weight move in opposite directions when said screw-threaded member is turned.

5. A ledger mechanism according to claim 1, in which the planetary gear meshes with the fixed gear through a compound idler gear which comprises a first gear meshing with said fixed gear and a coaxial second gear meshing with the planetary gear.

6. A ledger mechanism according to claim 5, in which the planetary gear overlaps the fixed gear.

7. A ledger mechanism according to claim 6, in which the fixed and planetary gears have equal numbers of teeth, while the first and second gears of the compound idler gear have teeth numbers in a ratio of 1:2.

* * * * *